US006354459B1

(12) United States Patent
Hagihara

(10) Patent No.: US 6,354,459 B1
(45) Date of Patent: Mar. 12, 2002

(54) CLOSING MECHANISM FOR OPENING OF CONTAINER

(76) Inventor: Tadashi Hagihara, 606 Dai2Skyheights, 120 Saiwai-cho, Nishimabashi, Matsudo-shi, Chiba 271 (JP)

( * ) Notice: Subject to any disclaimer, the term of this patent is extended or adjusted under 35 U.S.C. 154(b) by 0 days.

(21) Appl. No.: 09/445,542

(22) PCT Filed: Sep. 2, 1997

(86) PCT No.: PCT/JP97/03057

§ 371 Date: Dec. 9, 1999

§ 102(e) Date: Dec. 9, 1999

(87) PCT Pub. No.: WO98/56672

PCT Pub. Date: Dec. 17, 1998

(30) Foreign Application Priority Data

Jun. 9, 1997 (JP) ..... 9-150776

(51) Int. Cl.[7] ..... A47G 19/22

(52) U.S. Cl. ..... 220/705; 220/709; 220/717; 222/530

(58) Field of Search ..... 220/705, 703, 220/212, 255, 254, 706, 707, 708, 709, 717, 719; 222/512, 513, 527, 528, 530, 567, 569, 573, 574, 571; 215/387, 388, 389; 229/125.01, 125.04, 125.33, 119

(56) References Cited

U.S. PATENT DOCUMENTS 4,714,173 A * 12/1987 Ruiz ..... 220/709
4,876,788 A * 10/1989 Steer et al. ..... 222/574 X
5,201,460 A * 4/1993 Caines ..... 220/705 X
5,819,972 A * 10/1998 Puente Pubill ..... 220/705
5,897,013 A * 4/1999 Manganiello ..... 220/254 X

* cited by examiner

*Primary Examiner*—Allan N. Shoap
*Assistant Examiner*—Niki M. Eloshway
(74) *Attorney, Agent, or Firm*—Wenderoth, Lind & Ponack, L.L.P.

(57) ABSTRACT

Opposite sides of a closable passage body formed from a soft sheet are interposed between a support body bent at a predetermined curvature and an elastic material capable of closely contacting with the support body. The passage body is closed in a normal state but the elastic material deforms to open the passage body when a rod-shaped body is inserted into the passage body between the support body and the elastic material. The elastic material is caused by its restoring force to come into close contact with the support body to close the passage body when the rod-shaped body is pulled out. With a closing mechanism of the invention for an opening of a container, it is possible to subject the closing mechanism to waste disposal such as incineration together with the container after use, and to store the container for several separate eatings and drinkings, because the opening is automatically closed after use so that there is no possibility of spilling while grasping and carrying the container.

12 Claims, 20 Drawing Sheets

FIG.1(a-1)
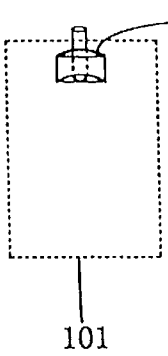
FIG.1(a-2)
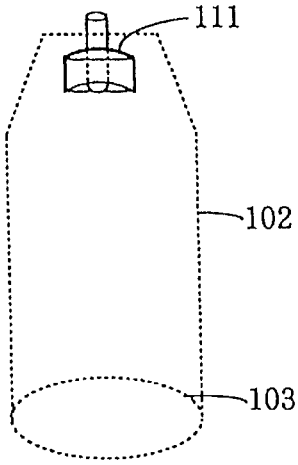
FIG.1(b-1)
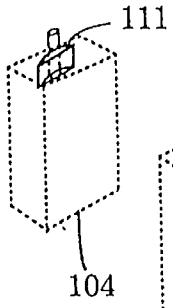
FIG.1(b-2)
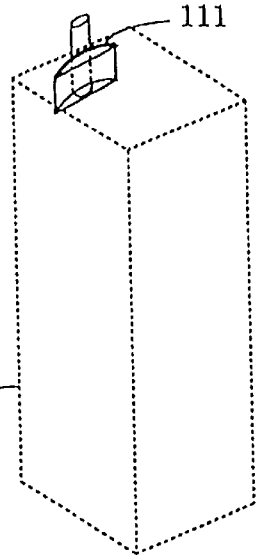
FIG.1(c-1)
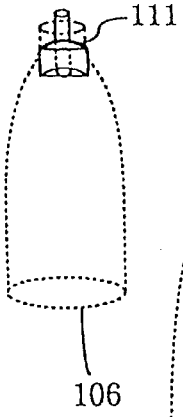
FIG.1(c-2)
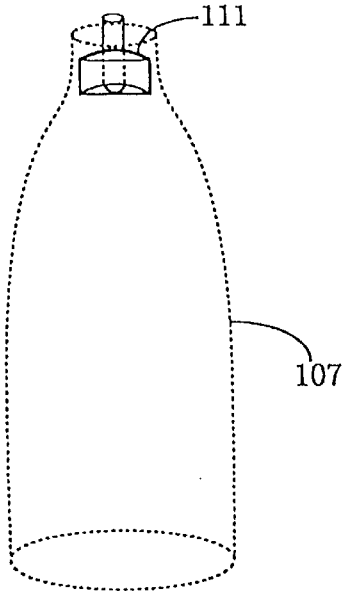
FIG.1(d)
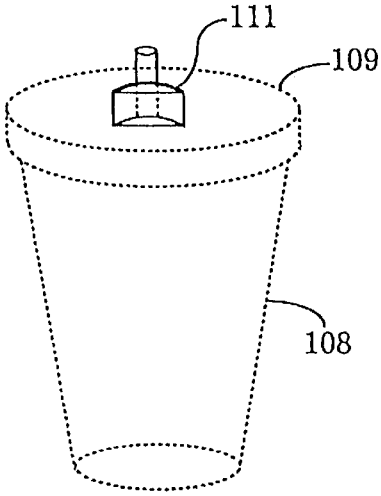

CLOSING MECHANISM FOR OPENING OF CONTAINER

TECHNICAL FIELD

The present invention relates to a closing mechanism for an opening of a container, which is applied to various kinds of containers such as bottles, PET bottles, cans, and paper packs.

BACKGROUND ART

Openings of containers such as glass bottles, PET bottles, cans, and paper packs are conventionally sealed by attaching a cap made of a material different from that of the container, forming pull-top type opening, or bonding a seal made of an evaporation film, or the like, into which a straw is inserted.

However, the glass bottles or the PET bottles to which a cap made of a material different from the container have disadvantages in that it takes a long time to attach or remove the cap to or from the opening of the container, the cap is easily lost, and the cap, different in material from the container, is difficult to dispose of after use.

Further, steel cans or aluminum cans having a pull-top type opening have disadvantages in that the pull-top is easily lost, and that it is difficult to store the container for several separate eatings and drinkings since the opening cannot be closed after having once been opened, and hence there is a possibility of spillage with difficult transportation.

Moreover, containers, such as paper packs, each of which has a bonded seal made of an evaporation film, or the like into which a straw is inserted, have disadvantages in that the contents spill out from the opening with the straw when carelessly grasping the paper pack, and that it is difficult to dispose of the seal, different in material from the container, after use.

A closing mechanism of the invention for an opening of a container aims to solve the above-mentioned disadvantages of the conventional examples. It is therefore an object of the present invention to provide a closing mechanism for an opening of a container, which is capable of subjecting the closing mechanism to waste disposal such as incineration together with the container at the time of waste disposal after use, and to store the container for several separate eatings and drinkings since the opening is automatically closed after use so that there is no possibility of spilling while grasping and carrying the container.

DISCLOSURE OF THE INVENTION

A closing mechanism of the invention for an opening of a container is characterized in that opposite sides of a closable passage body formed from a soft sheet are interposed between a support body bent at a predetermined curvature and an elastic material capable of closely contacting with the support body. The passage body is closed in a normal state, but the elastic material deforms to open the passage body when a rod-shaped body is inserted into the passage body between the support body and the elastic material. The elastic material is caused by its restoring force to come into close contact with the support body to close the passage body when the rod-shaped body is pulled out.

A closing mechanism of the invention for an opening of a container, is characterized in that opposite sides of a closable passage body formed from a soft sheet are interposed between a support body bent at a predetermined curvature and an elastic material capable of closely contacting with the support body. The passage body and the elastic body are interposed between the supporting body, at a predetermined curvature, and a lid body. The supporting body and the lid body are joined by joining means. The elastic body is pressed by the lid body so as to be bent at a predetermined curvature along the supporting body. The passage body is closed in a normal state, but the elastic material deforms to open the passage body when a rod-shaped body is inserted into the passage body between the support body and the elastic material. The elastic material is caused by its restoring force to come into close contact with the support body to close the passage body when the rod-shaped body is pulled out.

A closing mechanism of the invention for an opening of a container is characterized in that the joining means closably joins the supporting body and the lid body at their end portions by a hinge. The end portion of one of the supporting body and the lid body has a socket penetrating in the thickness direction, and the end portion of the other of the supporting body and the lid body has a hook which is fitted to the socket. Both of the supporting body and the lid body are fitted and joined to each other.

A closing mechanism of the invention for an opening of a container is characterized in that the supporting body, the elastic body, and the lid body are, respectively, accommodated in a cylindrical body formed from a soft sheet.

A closing mechanism of the invention for an opening of a container is characterized in that the supporting body or the lid body has a holding guide therearound.

A closing mechanism of the invention for an opening of a container is characterized in that the supporting body has an insertion guide at a location through which the rod-shaped body is inserted.

A closing mechanism of the invention for an opening of a container is characterized in that the lid body has ribs for pressing the passage body so as to be bent at a predetermined curvature along the supporting body.

A closing mechanism of the invention for an opening of a container is characterized in that the elastic material comprises an elastic plate for pressing the passage body so as to be bent at a predetermined curvature along the supporting body.

A closing mechanism of the invention for an opening of a container is characterized in that the elastic plate is selected from a plastic sheet, a metal sheet, or a composite sheet thereof.

A closing mechanism of the invention for an opening of a container is characterized in that the elastic material comprises an elastic body for pressing the passage body so as to be bent at a predetermined curvature along the supporting body.

A closing mechanism of the invention for an opening of a container is characterized in that the elastic body comprises an elastic tube.

A closing mechanism of the invention for an opening of a container is characterized in that the supporting body and the lid body each comprises a plastic molding.

A closing mechanism of the invention for an opening of a container is characterized in that the elastic material is selected from a plastic sheet, a metal sheet, or a composite sheet thereof.

A closing mechanism of the invention for an opening of a container is characterized in that the closable passage body formed from the soft sheet comprises two soft sheets adhered to each other at a boarder portion of the passage.

A closing mechanism of the invention for an opening of a container is characterized in that the soft sheet is selected from a rubber sheet, a plastic sheet, a watertight paper, a waterproof paper, an aluminum foil, or a composite sheet thereof.

With a closing mechanism of the invention for an opening of a container, it is possible to subject the closing mechanism to waste disposal such as incineration together with the container at the time of waste disposal after use, and to store the container for several separate eatings and drinkings since the opening is automatically closed after use, so that there is no possibility of spilling while grasping and carrying the container.

BRIEF DESCRIPTION OF THE DRAWINGS

FIGS. 1 are schematic views showing examples suited to a container to which is applied a closing mechanism of the invention for an opening of a container, in which FIGS. 1(*a*) show examples of a poly-bag and the like, FIGS. 1(*b*) show examples of a paper pack and the like, FIGS. 1(*c*) show an example of a glass bottle and the like, and a PET bottle and the like, and FIG. 1(*d*) shows an example of a paper cup and the like;

FIG. 2(*a*) shows a case in which the passage portion of the passage body is closed, and FIG. 2(*b*) shows a case in which the passage portion of the passage body opens and the contents of the container passes therethrough;

FIGS. 20 show a closable passage body of a-soft sheet, constituting the closing mechanism of the invention for the opening of the container, in which FIG. 20(*a*) shows a perspective view and sectional view at the point of A—A for a case in which the passage portion of the passage body is closed, and FIG. 20(*b*) shows a perspective view and sectional view at the point of A—A for a case in which the passage portion of the passage body opens, through which passes an object to be transferred, such as gasses, air, mucilage, powder, particulate matter, and the like;

BEST MODE FOR CARRYING OUT THE INVENTION

Figure 2A:
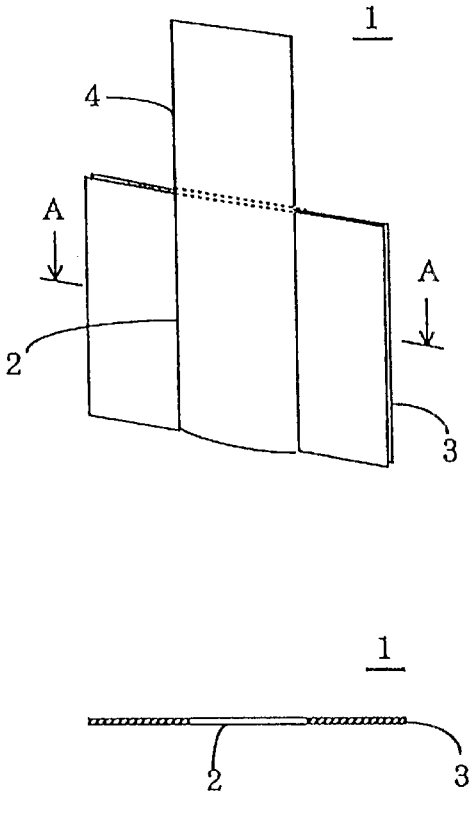
FIGS. 2 show a closable passage body formed from a soft sheet, which constitutes the closing mechanism of the invention for the opening of the container.

Embodiments of a closing mechanism for the invention of an opening of a container will now be described with reference to the drawings.

FIGS. 1(*a*) to 1(*d*) are schematic views showing examples suited to a container to which is applied an closing mechanism of the invention for an opening of a container (hereinafter referred to as "the closing mechanism").

FIGS. 1 (*a*) show examples of a poly-bag, and the like, in which FIG. 1 (*a*-1) shows a case in which a closing mechanism 111 of the invention is applied to a sheet-like bag-shaped container 101, and FIG. 1(*a*-2) shows a case in which the closing mechanism 111 of the invention is applied to a bag-shaped container 102 having a circular bottom 103.

FIGS. 1(*b*) show examples of a paper pack, and the like, in which FIG. 1(*b*-1) shows a case in which the closing mechanism 111 of the invention is applied to a relatively small paper pack 104 used for fruit juice, and the like, and FIG. 1(*b*-2) shows a case in which the closing mechanism 111 of the invention is applied to a relatively large paper pack 105 used for milk, and the like.

FIGS. 1(*c*) show examples of a glass bottle, and the like, and a PET bottle, and the like, in which FIG. 1(*c*-1) shows a case in which the closing mechanism 111 of the invention is applied to a small-sized glass bottle 106 used for a soft drink, and the like, and FIG. 1(*c*-2) shows a case in which the closing mechanism 111 of the invention is applied to a large-sized PET bottle 107.

FIG. 1 (*d*) shows an example of a paper cup in which the closing mechanism 111 of the invention is applied to a portion of a lid 109 provided on the paper cup 108.

The above closing mechanism 111 will be further described in detail hereinbelow.

Figure 2B:
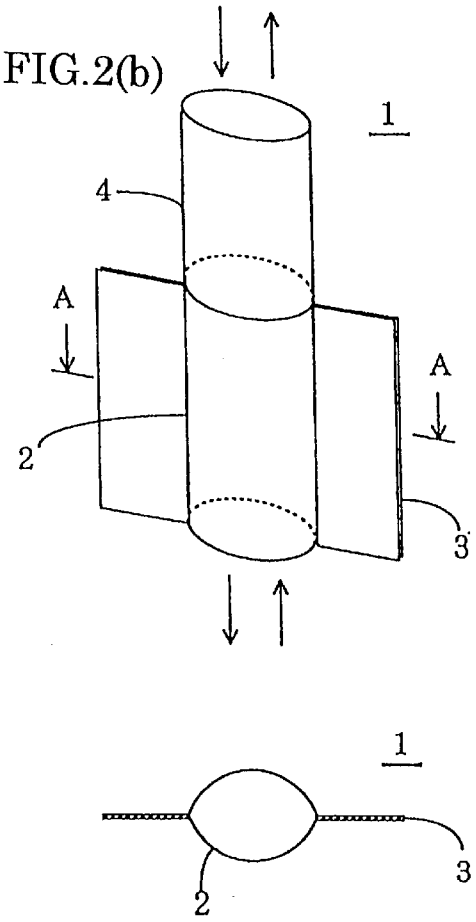
Figure 3A:
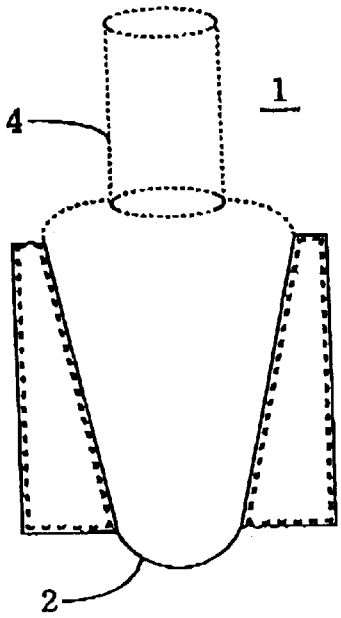
FIGS. 3(*a*) to 3(*d*) are schematic perspective views of the passage body made by bonding two soft sheets together due to heating and welding.
Figure 3B:
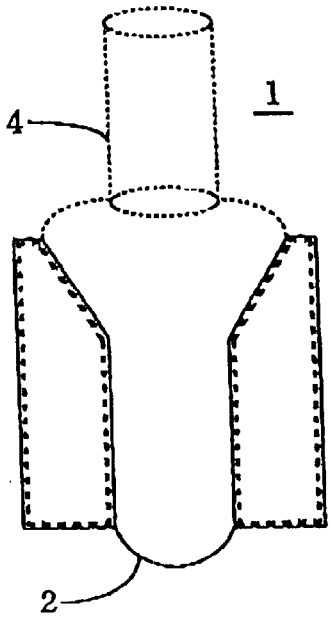
Figure 3C:
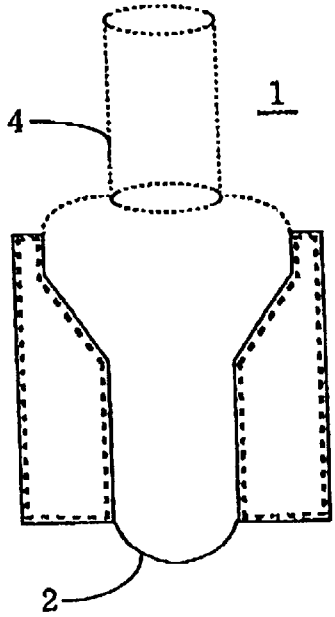
Figure 3D:
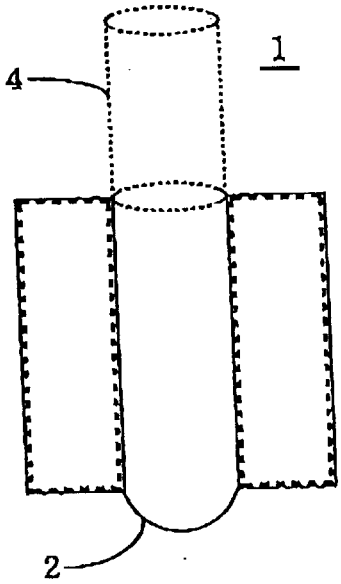

FIGS. 2 show a closable passage body 1 formed from a soft sheet, which constitutes the above-mentioned closing mechanism 111. Bonding two soft sheets together enables the passage body 1 to be prepared, thereby enabling a passage portion 2 to be opened like a cylinder. Further, on opposite sides of the passage portion 2 are formed locking pieces 3 interposed between a support body and an elastic material, described later, for holding the passage body 1. Reference numeral 4 designates a guide portion of the passage body 1 protruding at a location of the locking pieces 3.

The passage body 1 is preferably made of soft sheets selected from rubber sheets, plastic sheets, watertight papers, waterproof papers, aluminum foils, or composite sheets thereof.

FIG. 2(*a*) shows a case in which the passage portion 2 of the passage body 1 is closed, and FIG. 2(*b*) shows a case in which the passage portion 2 of the passage body 1 opens and the contents of the container passes therethrough.

FIGS. 3 show the passage portion 2 of the passage body 1 comprising two soft sheets bonded together due to heating and welding, FIG. 3(*a*) shows a taper-like passage portion 2 which converges toward the opposite side of the guide portion 4. FIG. 3(*b*) shows a passage portion 2 which converges toward the opposite side of the guide portion 4 and is then shaped like a cylinder at a leading end thereof. FIG. 3 (*c*) shows a passage portion 2 which has a predetermined width, converges toward the opposite side of the guide portion 3, and is then shaped like a cylinder at a leading end thereof. FIG. 3(*d*) shows a passage portion 2 shaped like a cylinder having the same diameter as the guide portion 4.

The width of the passage portion 2 of the passage body 1 is preferably set such that the rod-shaped body to be inserted can be inserted into the passage portion 2 without obstruction according to the diameter of the rod-shaped body to be inserted, and that the ventilation can be made around the inserted bar-like member. If so constructed, discharging the air inside the container through the periphery while filling the contents therein through the rod-shaped body enables the filling work to be carried out without obstruction.

Means for forming the passage portion 2 of the passage body 1, preferably, includes means for putting two soft sheets together, and heating and welding them at a portion of the locking pieces 3. However, it goes without saying that other forming means can be used. A border with the passage portion 2 needs only to be welded when welding the locking piece 3.

Figure 4A:
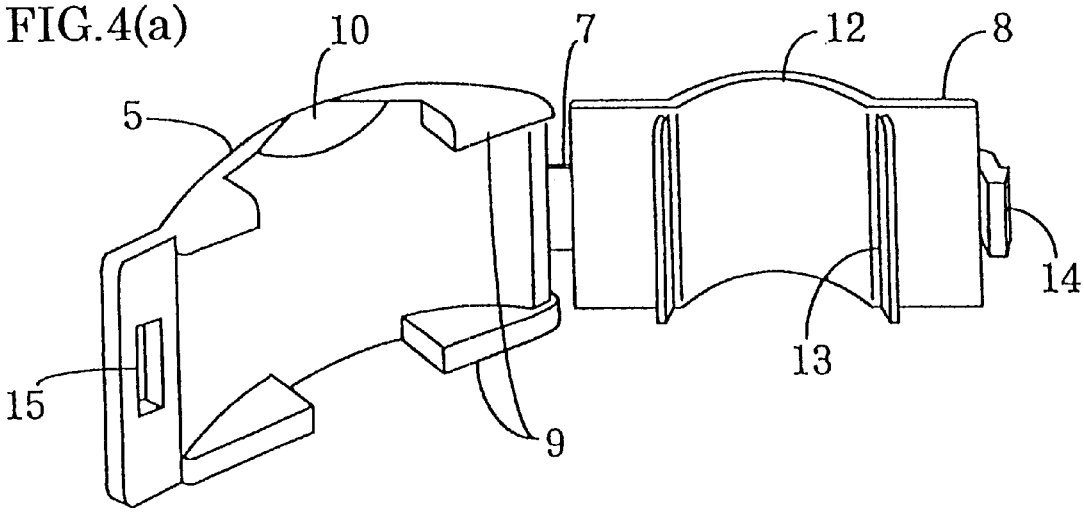
FIGS. 4(*a*) to 4(*c*) are perspective views of a supporting body and a lid body which are integrally formed.
Figure 4B:
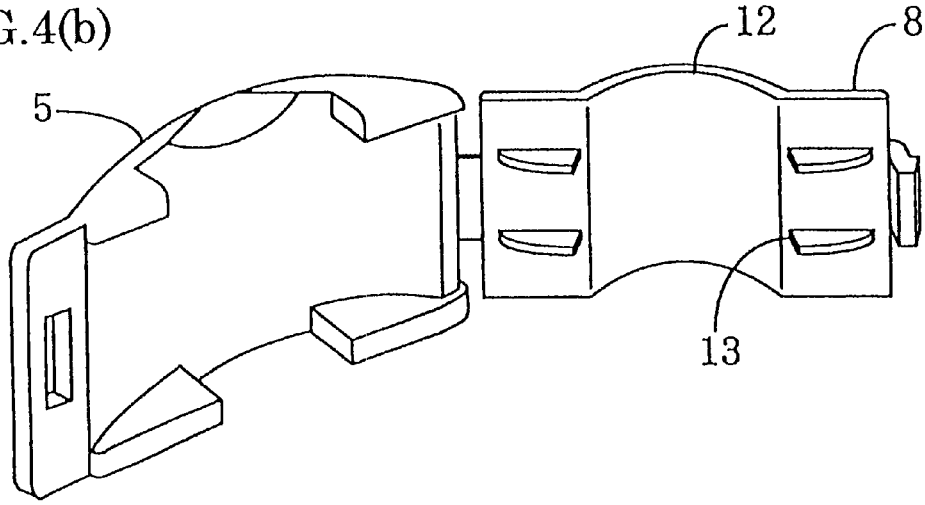
Figure 4C:
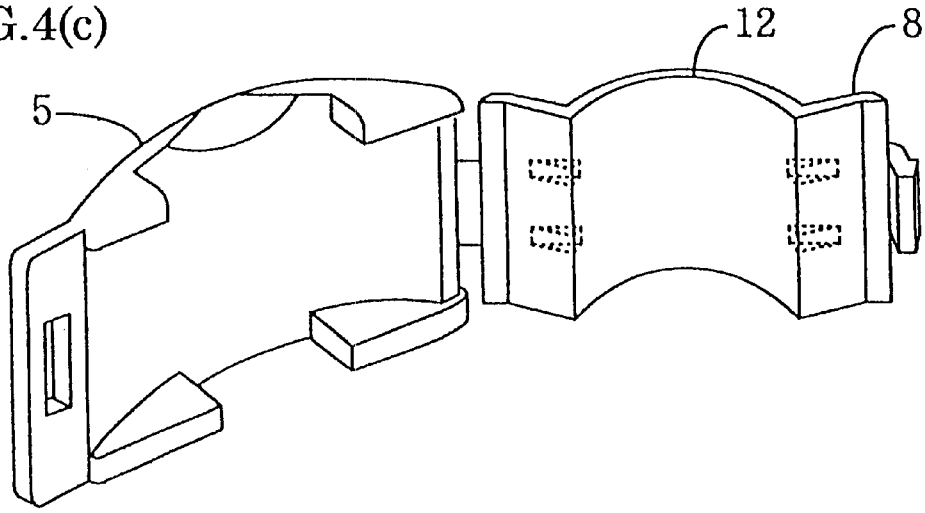

FIGS. 4(*a*) to 4(*c*) show an example of a supporting body 5 for use with an elastic plate 6 (see FIG. 5, e.g.) for causing the passage body 1 to be interposed therebetween, and hence closing, and particularly automatically sealing, the passage body 1. The supporting body 5 and the elastic plate 6 are independently formed. A lid body 8 is formed on an end portion of the supporting body 5 through a plastic hinge 7 so as to extend in the lateral direction. The supporting body 5, the plastic hinge 7 and the lid body 8 are formed into a predetermined shape by injection-forming a plastic material such as polyethylene, polypropylene, polyester, polycarbonate, etc. The forming method is, of course, not limited to injection-forming.

In FIG. 4(*a*), holding guides 9 protrude on opposite sides of an upper portion of the supporting body 5 and on opposite sides of the lower portion. Also, an inserting guide 10 is provided on a center portion of the upper end of the supporting body 5 at a location where the rod-shaped body is inserted.

In the example of FIG. 4(*a*), the lid body 8 is made from a flat plate substantially on a center of which is provided a guide groove 12 of arc-like section for accommodating the passage body 1 through which the rod-shaped body passes. On opposite sides of the groove 12 a pair of ribs 13 for pressing the elastic plate 6 are provided in the longitudinal direction of the passage body 1. The shape, the location, and the number of the ribs 13 can be suitably determined according to the thickness and the size of the elastic plate 6. However, the shape, location, and the number of the ribs 13 is desirably determined so as to control the speed of response of closing the elastic plate 6.

Further, reference numeral 14 designates a hook provided at an end portion of the lid body 8 to join it to the supporting body 5. The hook 14 is fitted in and locked through a socket 15, provided on an end portion of the supporting body 5 so as to penetrate therethrough in the thickness direction. Fixing the supporting body 5 and the elastic plate 6 together with the lid body 8 while bending them at a predetermined curvature makes the closing mechanism 111 superior in durability.

In an example of FIG. 4(*b*), the lid body 8 has ribs 13 for pressing the elastic plate 6 at opposite sides of the guide groove 12 in a direction perpendicular to the longitudinal direction of the passage body 1.

In an example of FIG. 4(*c*), the lid body has the opposite sides that are connected to the guide groove 12 provided with an arc-like section which is inwardly, inclined, and has no rib 13 for pressing the elastic plate 6.

The above exemplifies a joining means comprising the hook 14 and the socket 15. However, not only such joining means but also other shape and constructions, or welding means, can be utilized.

Moreover, the supporting body 5 and the lid body 8 may be identical in thickness with each other, or may be different in thickness from each other. In conjunction with the passage body 1, the supporting body 5 and the lid body 8 are required to have a thickness so as not to be deformed, the passage body 1 is required to be made of a thin material to provide flexibility, and the elastic body 6 is required to have a predetermined thickness in view of the function. The elastic body 6 is, of course, desirably thicker than the passage body 1.

The passage body 1 and the elastic plate 6 each can be made of a plastic sheet, a metal sheet, or a composite sheet thereof. The plastic sheet is made of polyethylene, polypropylene, polyester, polycarbonate, or the like. The passage body 1 is preferably made of the same material.

The elastic plate 6 is preferably about 0.1–0.5 mm in thickness if it is made of a plastic sheet such as ethylene. The supporting body 5 and the elastic plate 6 each is preferably about 2–1.5:1 in aspect ratio taking the case of a rectangle. For example, the lateral axis/the longitudinal axis is 40 mm/25 mm, 35 mm/20 mm, 30 mm/11 mm.

The radius of curvature obtained when bending the supporting body 5 and the elastic plate 6 is preferably 11–40 mm. If the radius of curvature is small, the force of the passage body 1 being interposed between the supporting body 5 and the elastic plate 6 becomes strong. On the other hand, enlarging the curvature enables adjusting the force of the passage body 1 being interposed between the supporting body 5 and the elastic plate 6 and controlling the force when the rod-shaped body is inserted and taken out.

As to the material, any one of the plastic materials, and the sheets, and the like constituting the passage body 1, the supporting body 5, the elastic body 6, and the lid body 8 is preferably made of a single material. For example, the plastic-based materials, or a composite sheet of the plastic-based materials and the aluminum foil, or the like, which are usually used in home, and the like, preferably solves the above-mentioned problems of the present invention in flexibility, workability, and treating ability after material disposal.

Figure 5:
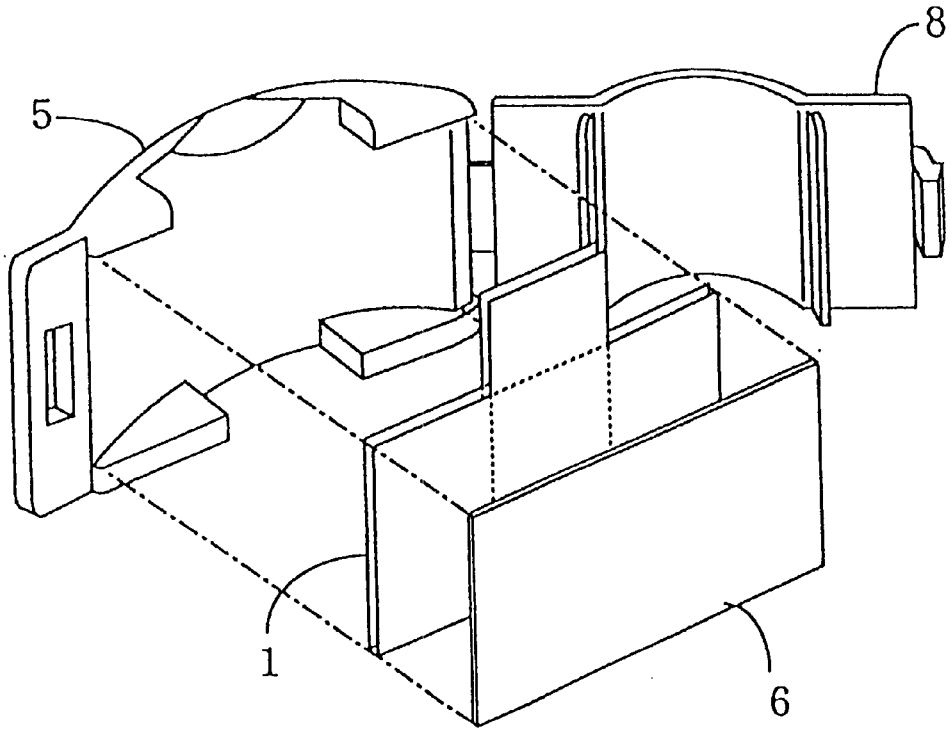
FIG. 5 is a perspective view showing an example in which the lid body opens from the supporting body.
Figure 6:
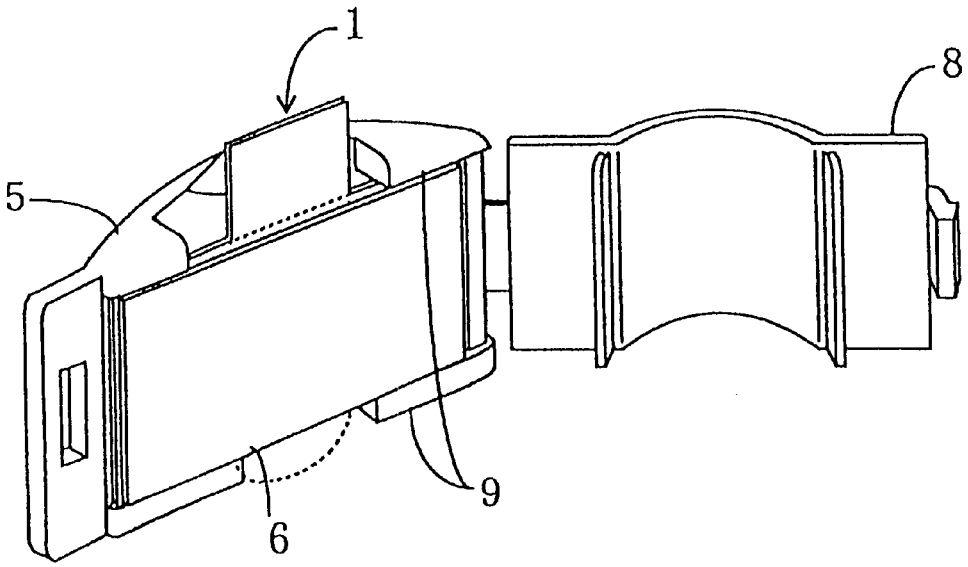
FIG. 6 is a perspective view of the supporting body and the lid body which cause the passage body to be interposed therebetween.
Figure 7:
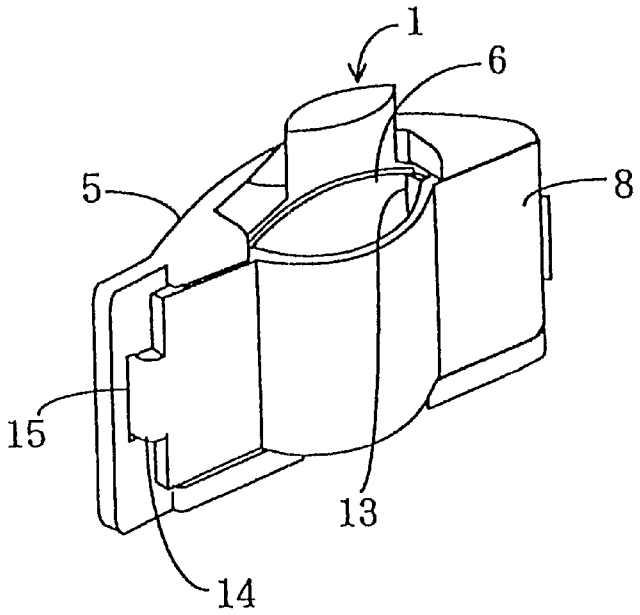
FIG. 7 is a perspective view of the supporting body and the lid body which are joined to each other.

FIGS. 5 to 9 show a closing mechanism 111 of the invention by the passage body 1 being interposed between the supporting body 5 and the elastic plate 6. That is, FIG. 5 shows a state in which the lid body 8 opens from the supporting body 5, FIG. 6 shows a state in which elongated sheets constituting the passage body 1 and the elastic plate 6 are accommodated along the holding guide 9 of the supporting body 5, and FIG. 7 shows a state in which the hook 14 of the lid body 8 is fitted in the socket 15 of the supporting body 5, and then opposite sides of the passage body 1 are interposed therebetween. In FIG. 7 showing the finished state, the passage body 1 is pressed against the ribs 13 of the lid body 8 together with the elastic plate 6.

Figure 8:
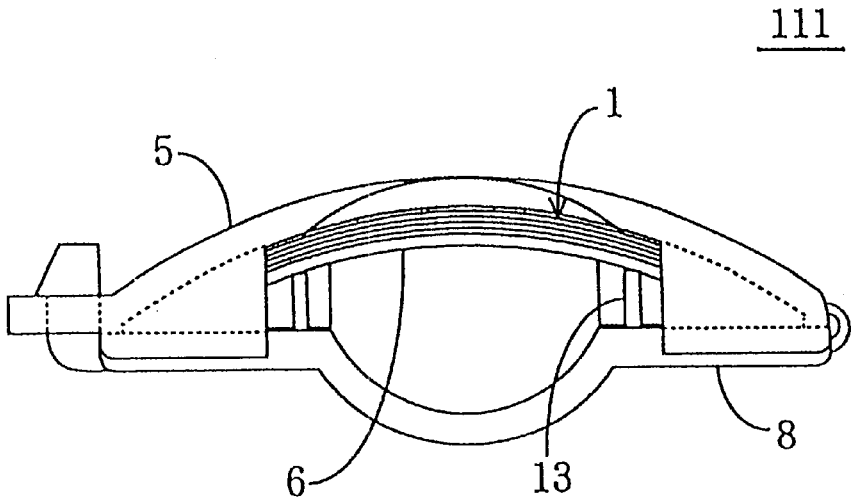
FIG. 8 is an enlarged plan view of the supporting body and the lid body which are joined to each other.
Figure 9:
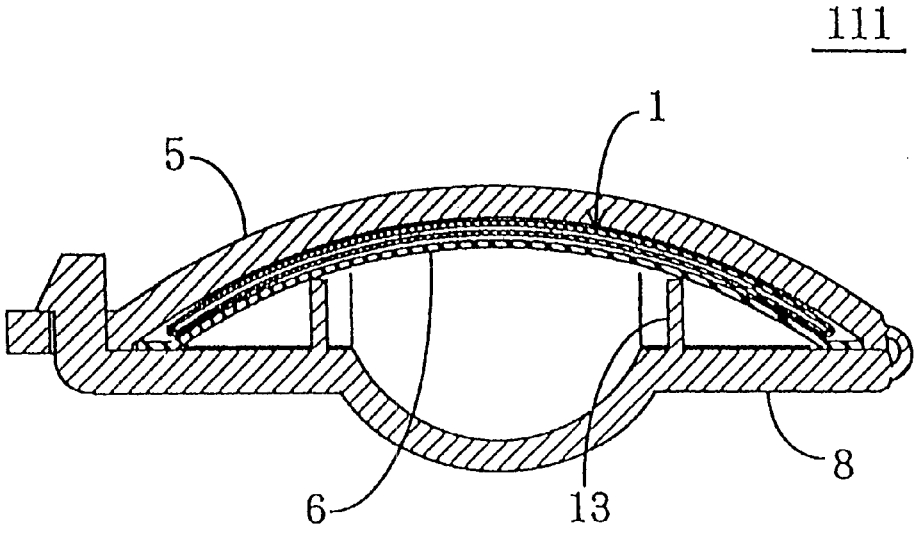
FIG. 9 is an enlarged sectional view of the supporting body and the lid body which are joined to each other.

In the closing mechanism 111 assembled as stated above, the passage body 1 is, as shown in FIGS. 8 and 9, held like an arc in a state in which the passage body 1 is bent due to the curvature of the supporting body 5 and the elastic plate 6, and the lid body 8 is located at a cord. If so constructed, the elastic plate 6 can be held in shape by the lid body 8 along the supporting body 5, and hence can be surely held in curvature by the ribs 13, which enables the passage body 1 to be strongly pressure-fitted.

The operation of the thus-constructed closing mechanism of the invention for the opening of the container will be described hereinbelow.

Figure 10:
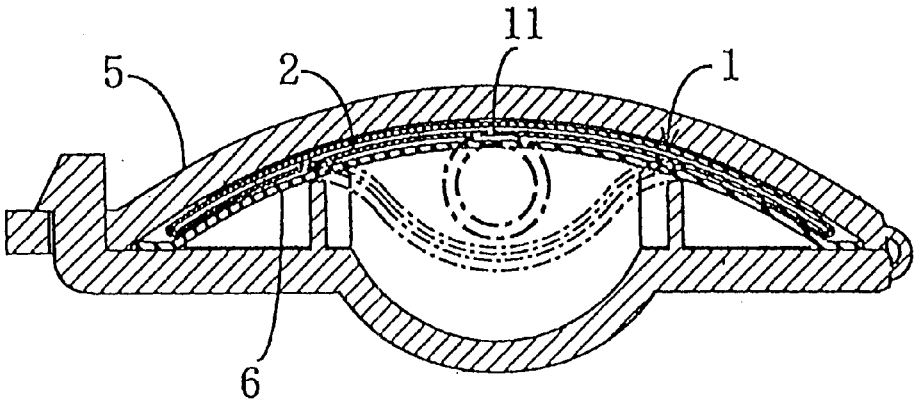
FIG. 10 is an enlarged sectional view of a rod-shaped body being inserted into the passage body.

FIG. 10 shows a state in which the rod-shaped body 11, such as a straw, is inserted into the passage body 1. In the closing mechanism 111, inserting the rod-shaped body 11 into the passage portion 2 of the passage body 1 causes the passage portion 2, which is intimately contacted by the supporting body 5 and the elastic plate 6, to be shoved open, which provides a passage. In this embodiment, the use of the straw as the rod-shaped body 11 more surely provides the passage.

Figures 11A, 11B, 11C, 11D:
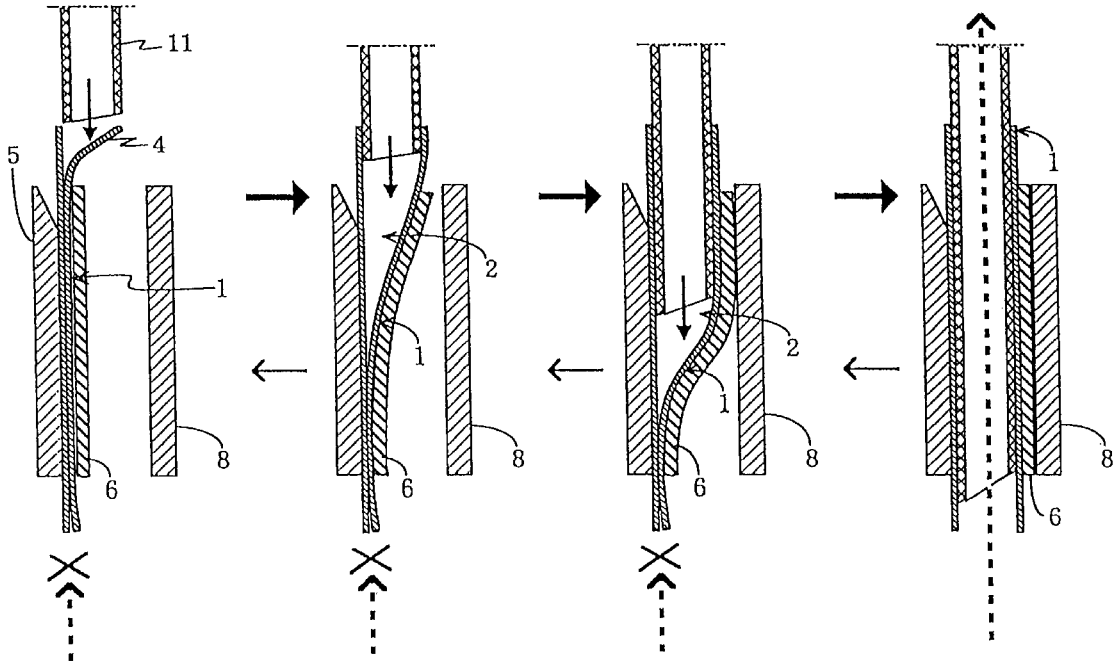
FIGS. 11(*a*) to 11(*d*) are sectional views of the rodshaped body being inserted into the passage body shown in stages.

FIG. 11 illustrates the above-mentioned operation in more detail. A distal end of the rod-shaped body 11 is first inserted through an upper end of the guide portion 4 of the passage body 1. Actually, this portion is provided with a cap or an attaching port, which makes it easy to insert the rod-shaped body 11. Then, gradually pressing down the rod-shaped body 11, as shown in FIGS. 11(*a*) to 11(*c*), causes the passage portion 2 of the passage body 1 to be opened together with the elastic plate 6.

Further pressing down the rod-shaped body 11 causes the elastic plate 6, which is pressed against the supporting body 5 by the lid body 8, to be opened over the total length of the rod-shaped body 11, which enables the contents in the container to freely pass therethrough as shown in FIG. 11(*d*).

To close the opening of the container, the rod-shaped body 11 needs only to be pulled out, thereby causing the elastic plate 6 to gradually return to an initial position in intimate contact with the supporting body 5, which in turn causes the passage portion 2 of the passage body 1 to be in intimate contact over its total length, tracing back from FIG. 11(*d*) to FIG. 11(*a*). When the closing mechanism 111 provided on the opening of the container receives pressure to push out the contents from the container, the pressure is transmitted to the passage body 1 through the supporting body 5 and the elastic plate 6, which causes the passage portion 2 of the passage body 1 to be sealed further tightly.

Figure 12:
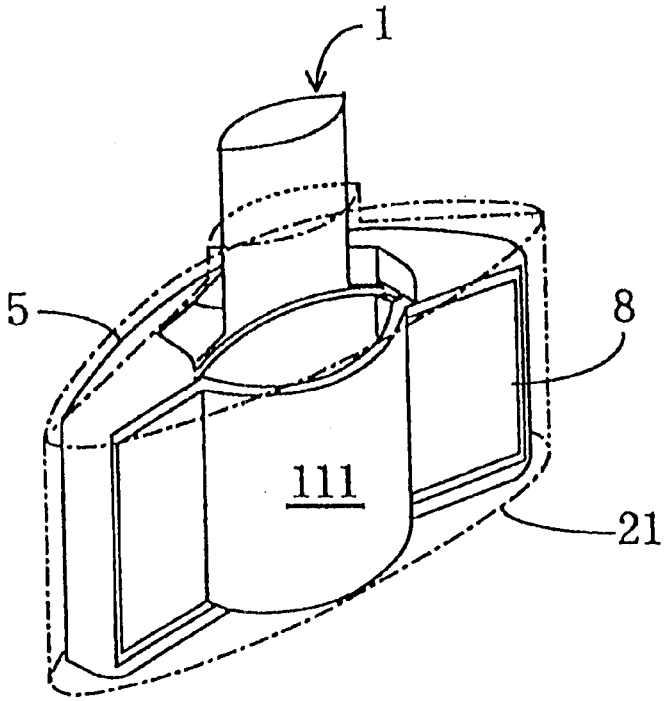
FIG. 12 is a perspective view of another embodiment of the closing mechanism of the invention for the opening of the container.
Figure 13:
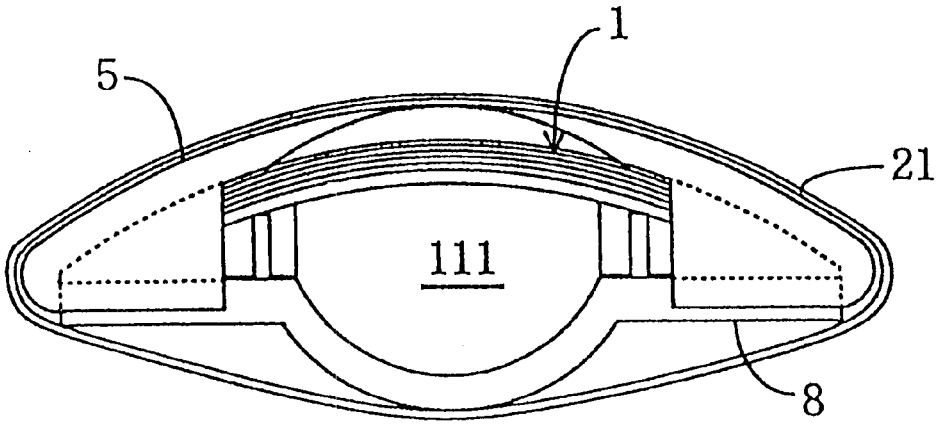
FIG. 13 is a plan view of the same.
Figure 14:
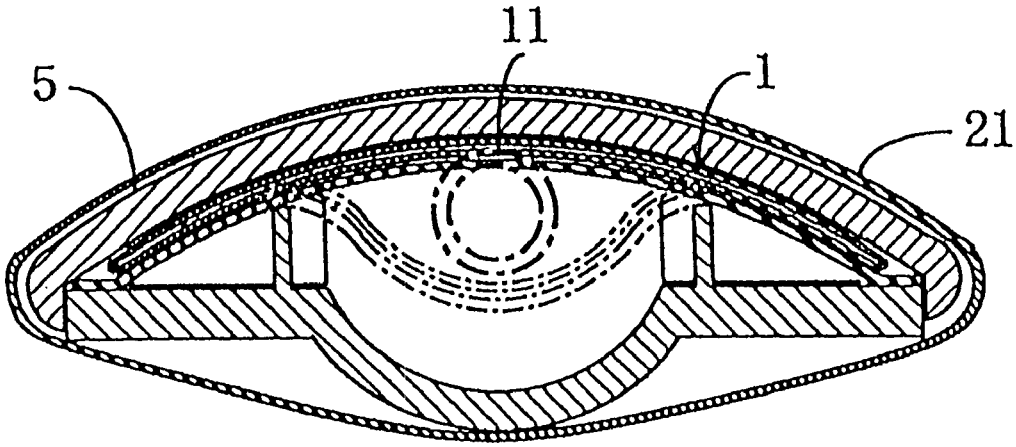
FIG. 14 is a sectional view of the same, showing a service condition.
Figure 15:
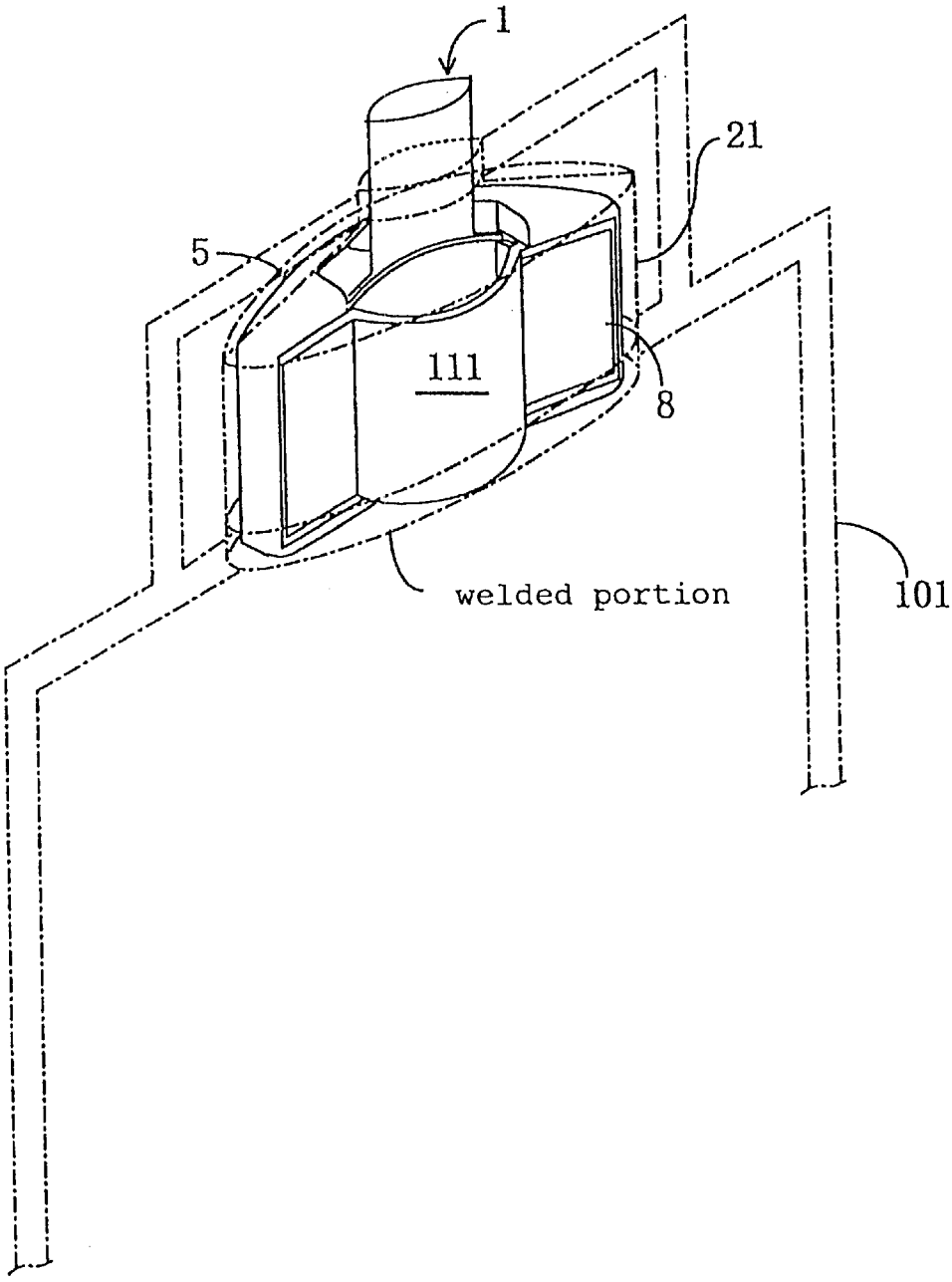
FIG. 15 is a perspective view of the same in a case where the closing mechanism is attached to a poly-bag.

FIGS. 12 to 15 show an example in which the closing mechanism of the invention for the opening of the container is attached to a cylindrical body 21. FIG. 12 is perspective view, FIG. 13 is a plan view, and FIG. 14 is a sectional view, and FIG. 15 is a perspective view of the closing mechanism 111 being attached to the bag-shaped container 101.

In this embodiment, in stead of the joining means comprising the plastic hinge 7, the hook 14, and the socket 15, a combination of the supporting body 5 and the lid body 8 is accommodated in the cylindrical body 21 formed from a soft sheet. The cylindrical body 21 is sealingly welded to the upper portion of the closing mechanism 111, except for a portion through which the passage body 1 passes, and then opens in a cylindrical manner at a lower portion thereof.

FIG. 15 shows a state in which the cylindrical body 21, accommodating the closing mechanism 111, is welded to the sheet-like bag-shaped container 101, with the passage body inserted, at an upper portion thereof, and welded in to the sheet-like bag-shaped container 101 while opening in a cylindrical manner at a lower portion thereof. Therefore, in a portion of the sheet-like bag-shaped container 101 accommodating the closing mechanism 111, the contents of the sheet-like bag-shaped container 101 enters into only a portion of the cylindrical body 21, which remarkably decreases the amount of the contents remaining inside the sheet-like bag-shaped container 101.

The material of the soft sheet constituting the cylindrical body 21 can be selected from a plastic sheet, a metal sheet, or a composite sheet thereof. The plastic sheet is made of polyethylene, polypropylene, polyester, polycarbonate, etc. The passage body 1 is preferably made of the same material. Moreover, it is desirable to make the work of accommodating the closing mechanism 111 easy by using a heat-shrinkable material, and then to heat and shrink the material to thereby surely cover the closing mechanism 111.

Figure 16:
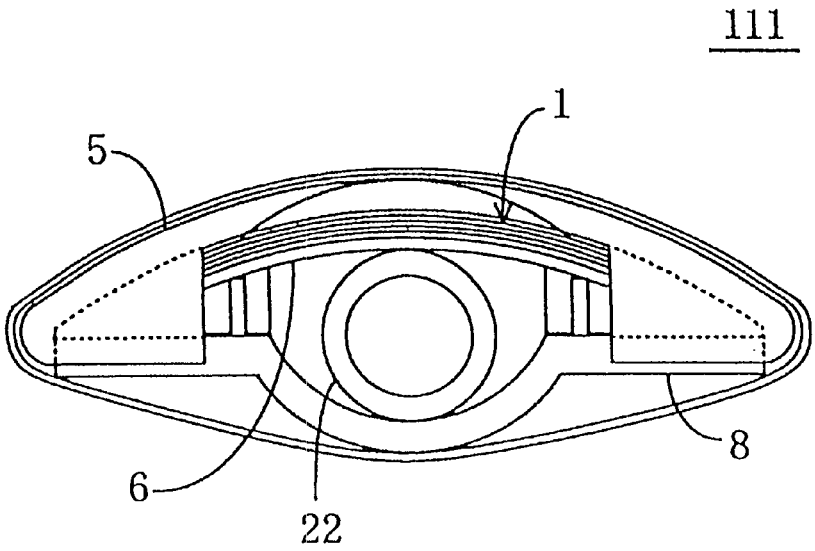
FIG. 16 is a plan view of still another embodiment of the closing mechanism of the invention for the opening of the container.
Figure 17:
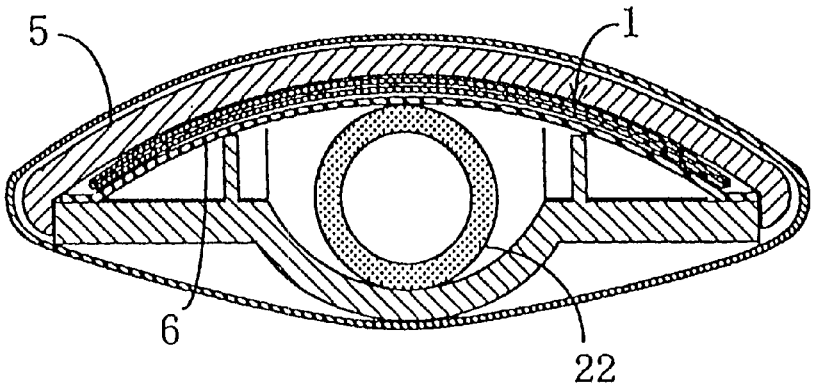
FIG. 17 is a sectional view of the same.
Figure 18:
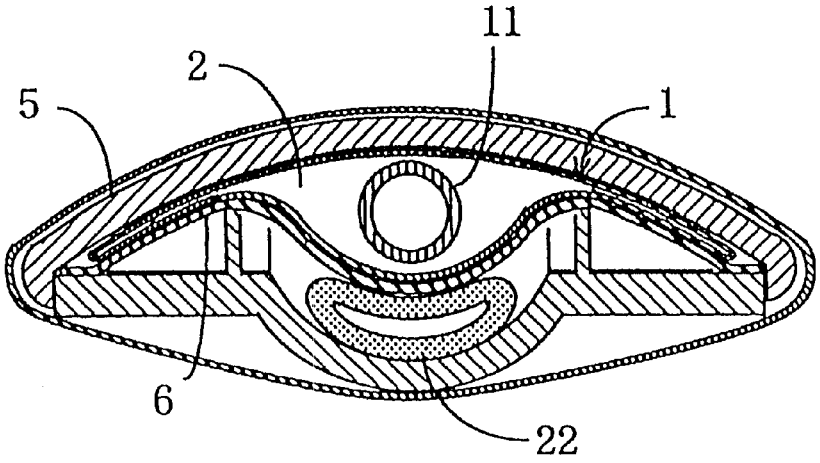
FIG. 18 is a sectional view of the same, showing a service condition.

FIGS. 16 to 18 show another example of the closing mechanism of the invention for the opening of the container, in which FIG. 16 is a plan view of the same, FIG. 17 is a sectional view of the same, and FIG. 18 is a sectional view of the same, showing a service condition.

Figure 19:
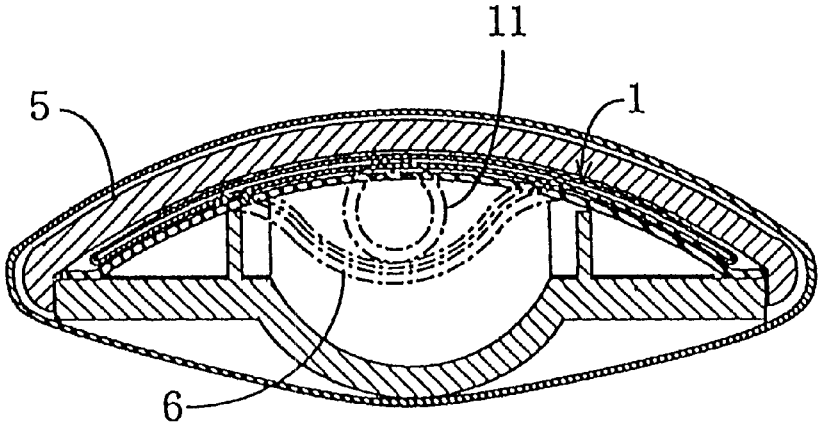
FIG. 19 is a sectional view of the same, with an elastic body and rod-shaped body removed.

When the closing mechanism of the invention for the opening of the container is applied to the bag-shaped container 101, filling the heated contents into the bag-shaped container 101 causes the passage body 1 of a thin film and the elastic plate 6 arranged inside to be unexpectedly thermally deformed, thereby preventing the elastic plate 6 and the like from returning to the initial condition, as shown in FIG. 19, even after the rod-shaped body 11 is pulled out from the passage body 1, which prevents the passage portion 2 from being sealed, and results in unexpectedly leaking contents. In this embodiment, interposed between the elastic plate 6 and the lid body 8 is an elastic body 22 for keeping the elastic plate 6 bent along the supporting body 5 at a predetermined curvature.

Although the elastic body 22 can be made of various kinds of materials, it is desirable to use a tube made of rubber, e.g. silicon rubber, from the viewpoint of heat-resistance, repellent elasticity, ease of construction, economy, and the like.

When using the embodiment, the passage body 1 of a straw is, as shown in FIG. 18, inserted into the passage body 1 of the closing mechanism 111, in which the elastic body 22 have been preliminarily set as shown in FIG. 17. The elastic body 22 is pressed by the presence of the rod-shaped body 11. When the rod-shaped body 11 is removed from the closing mechanism 111 after use, the elastic body 22 returns to its initial size as shown in FIG. 17. In this embodiment, the pressing force of the elastic body 22 toward the supporting body 5 is strong, which eliminates the need for using the elastic plate 6.

Figure 20A:
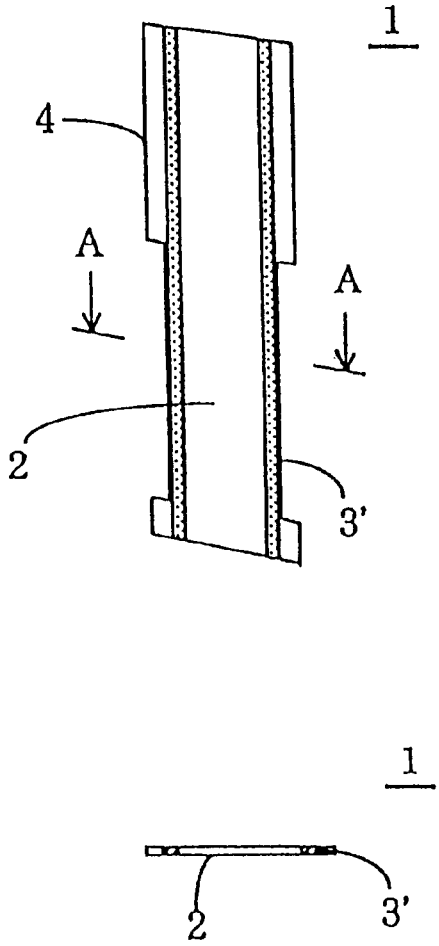
Figure 20B:
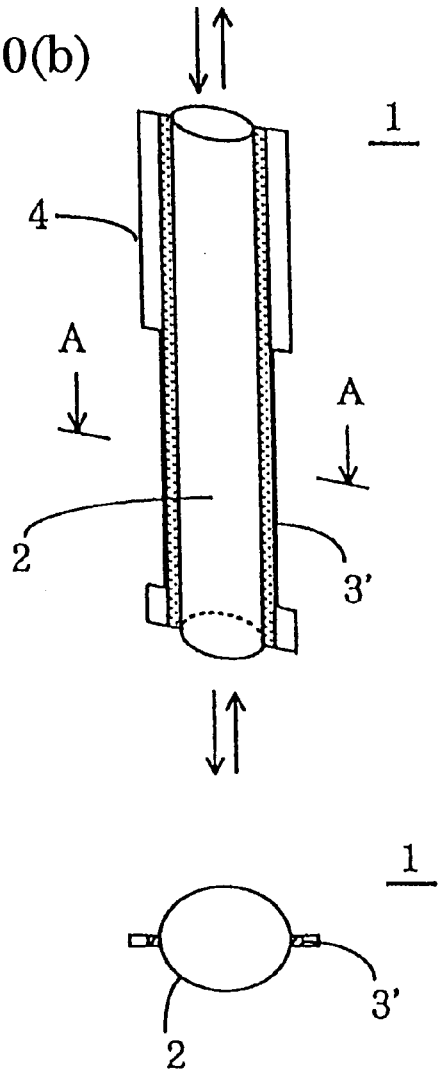

FIGS. 20 to 28 show another embodiment of the closing mechanism 111 of the invention for the opening of the container. First, FIGS. 20 show the closable passage body 1 of a soft sheet, constituting the closing mechanism 111. The passage body 1 can be made of two soft sheets bonded together, and then the passage portion 2 can open in a cylindrical manner. Formed on opposite sides of the passage portion 2 is a locking notch 3' which is fitted into the supporting body, described later, for holding the passage body 1. Reference numeral 4 designates a guide portion of the passage body 1 protruding at a location of the locking notch 3'.

FIG. 20(*a*) shows a case in which the passage portion 2 of the passage body 1 is closed, and FIG. 20(*b*) shows a case in which the passage portion 2 of the passage body 1 opens, through which an object to be transferred passes.

Figure 21A:
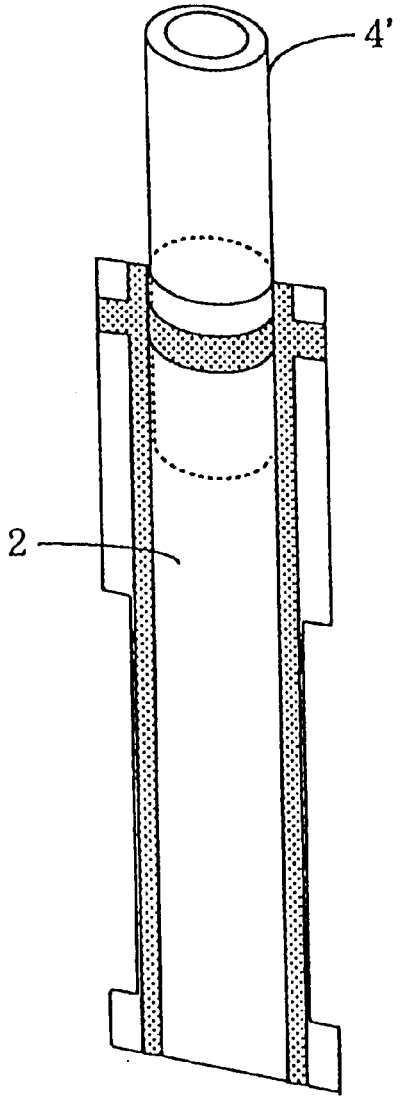
FIGS. 21 are schematic perspective views showing a case in which the passage portion of the passage body is thermally welded to two soft sheets bonded together, in which FIG. 21(*a*) shows a case in which there is provided an insertion guide at an upper end thereof, and FIG. 21(*b*) shows a case in which the rod-shaped body is inserted into the insertion guide.
Figure 21B:
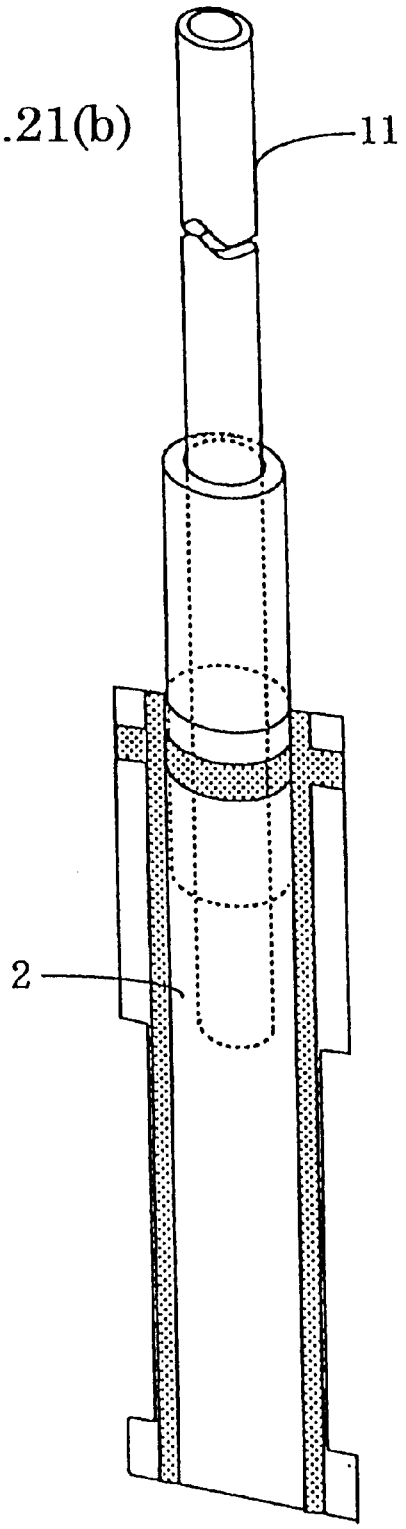

FIGS. 21 show a case in which the passage portion 2 of the passage body 1 is thermally welded to two soft sheets bonded together, in which FIG. 21(*a*) shows a case in which there is provided a relatively hard guide portion 4' which facilitates the insertion of the rod-shaped body 11, described later, and FIG. 21(*b*) shows a case in which the rod-shaped body 11 is inserted into the guide portion 4'.

Figure 22:
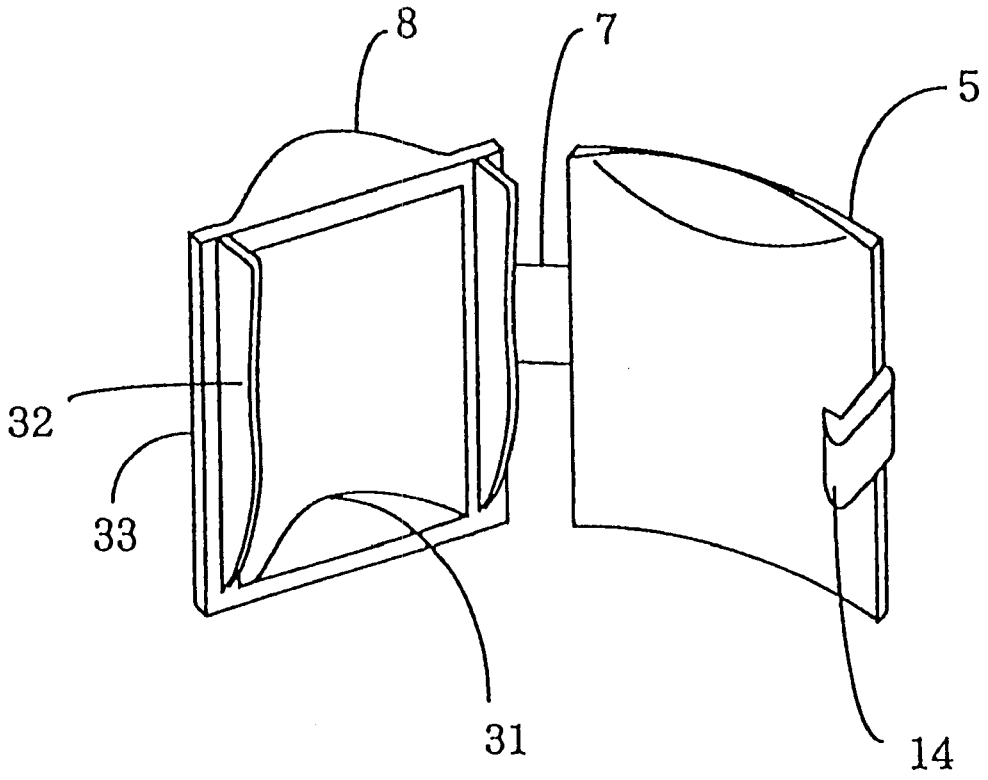
FIG. 22 is a perspective view of an outer pressing spring plate and the lid body which are integrally formed.

FIG. 22 shows an example of the supporting body 5 and the lid body 8 for closing, and in particular intimately closing, the passage body 1 by interposing the passage body 1 therebetween. The supporting body 5 and the lid body 8 are integrally formed through the plastic hinge 7. In FIG. 22, the supporting body 5 is held at a predetermined curvature. The lid body 8 has a recess portion 31 at a center thereof, having a depth such that the section of the elastic body 22, described later, slightly protrudes toward a center portion. It further has ribs 32 at opposite left and right sides thereof, which extend in the up and down direction and are arranged parallel with each other, for positioning the passage portion 2.

Reference numeral 14 designates a hook provided on an end portion of the supporting body 5 for joining the supporting body 5 to the lid body 8. The hook 14 is adapted to be engaged with an end portion 33 of the lid body 8. It may be, of course, fitted in a socket provided on the end portion 33 of the lid body 8 and penetrating in the thickness direction; the hook 14 then penetrates therethrough with sure engagement, enabling the passage body 1 to be fixed in a bent manner, which makes the closing mechanism 111 superior in durability.

Figure 23A:
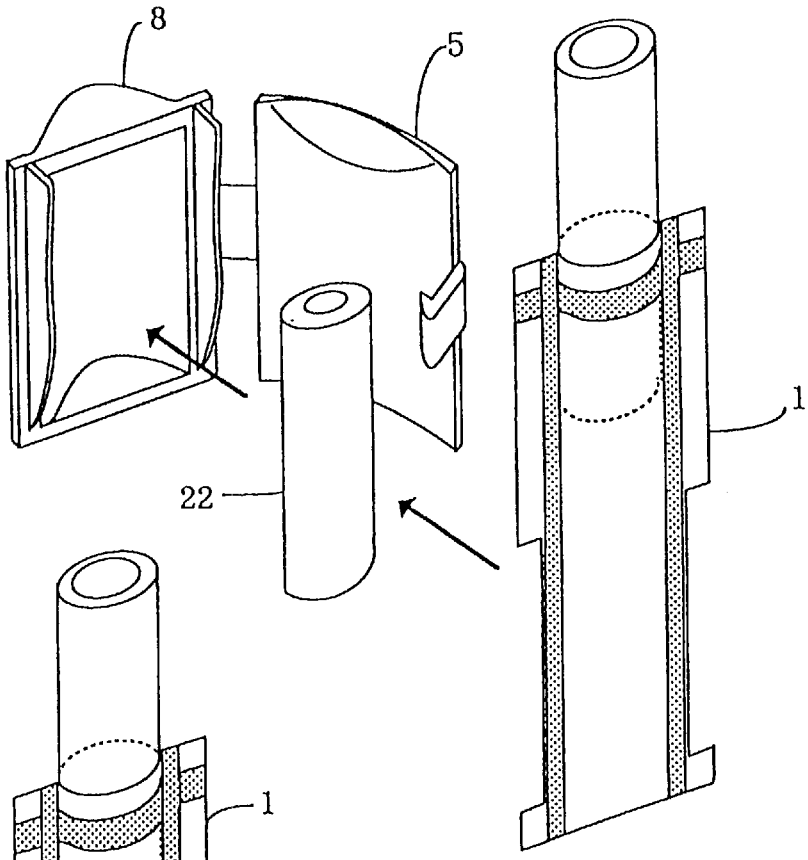
FIG. 23 is a schematic perspective view of the closing mechanism of the invention attached to the opening of the container, in which FIG. 23(*a*) shows a state before the closing mechanism is attached to the opening of the container, and FIG. 23(*b*) shows a state just before the lid body is closed.
Figure 23B:
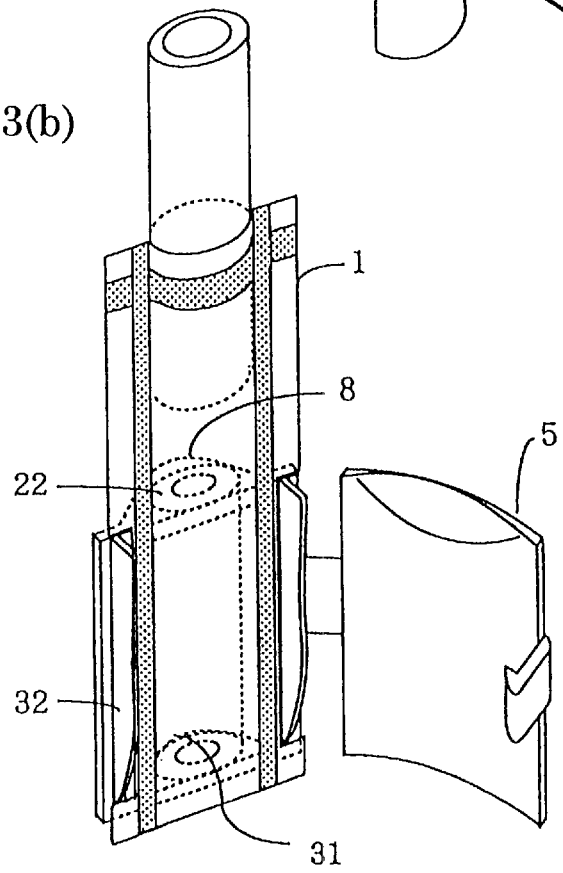
Figure 24:
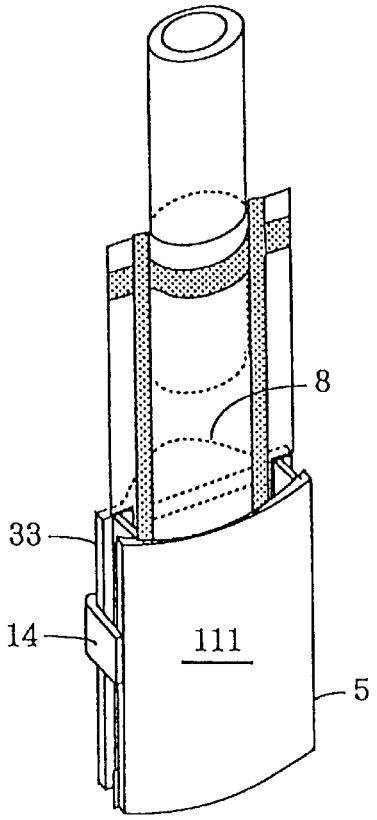
FIG. 24 is a perspective view of the outer pressing spring plate and the lid body which are joined to each other.
Figure 25:
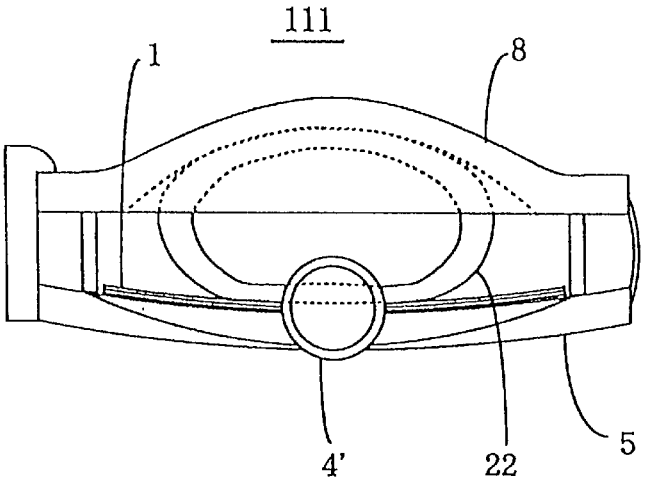
FIG. 25 is a plan view of the outer pressing spring plate and the lid body which are joined to each other.
Figure 26:
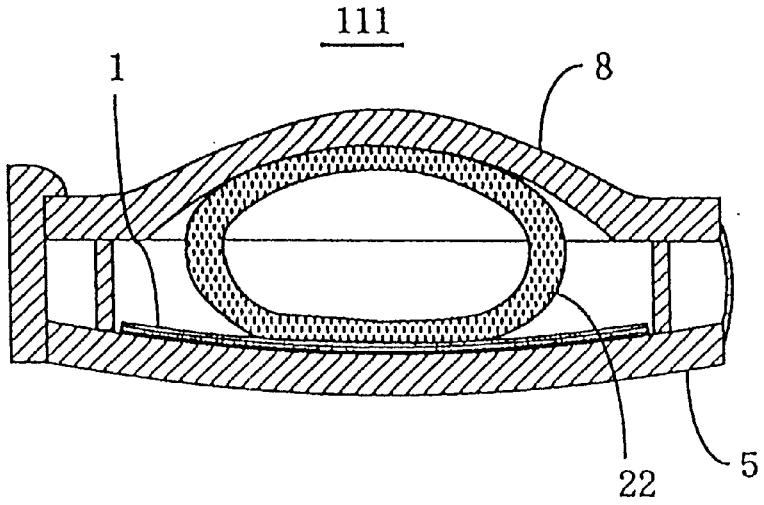
FIG. 26 is a sectional view of the same.
Figure 27:
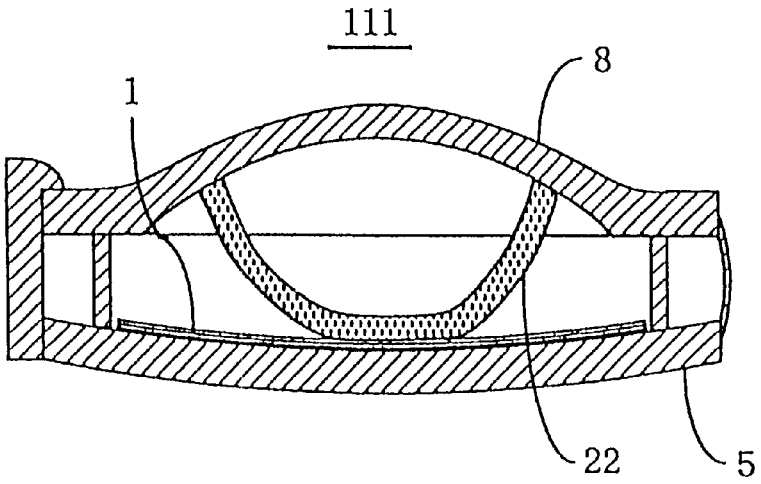
FIG. 27 is a sectional view of an elastic body according to another example.

FIGS. 23 to 26 show a state in which the closing mechanism 111 of the invention for the opening of the container is constructed by interposing the passage body 1 between the supporting body 5 and the elastic body 22. FIG. 23(*a*) shows a state in which the closing mechanism 111 is assembled. FIG. 23(*b*) shows a state in which the elastic body 22 is arranged in the recess portion 31 of the lid body 8. The passage body 1 is accommodated along the positioning rib 32. FIGS. 24 and 25 show a state in which the opening and closing mechanism 111 is assembled with the hook 14 of the supporting body 5 engaged with the end portion 33 of the lid body 8. FIG. 26 is a lateral sectional view of the completed opening and closing mechanism 111. The passage body 1 is pressed against the supporting body 5 by the elastic body 22 held on the lid body 8. Reference numeral 4' designates the above-mentioned relatively hard guide portion.

The shape of the elastic body 22 is not limited to a circular section. Any other shape, such as a semi-circle, e.g. shown in FIG. 27 maybe, of course, employed, insofar as it capable of surely pressing the passage body 1 against the supporting body 5.

In the thus constructed opening and closing mechanism 111, the passage body 1 is pressed against the supporting body 5 by the elastic body 22, which enables the passage body 1 to be held at a predetermined curvature along the supporting body 5. This enables the passage body 1 to be held along the supporting body 5 through the elastic body 22, and be surely kept in curvature, which enables the passage body 1 to be strongly pressure-fitted.

The operation of thus constructed closing mechanism of the invention for the opening of the container will be described hereinbelow.

Figure 28:
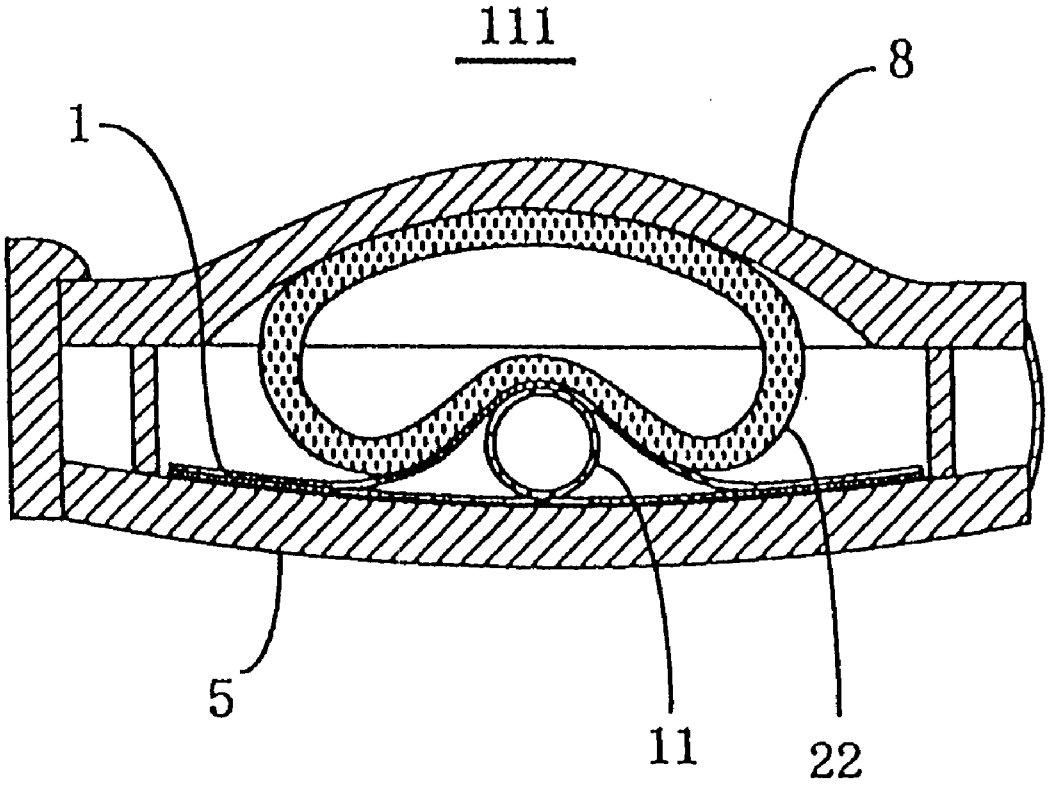
FIG. 28 is a sectional view of the passage body into which the rod-shaped body is inserted.

FIG. 28 shows a state in which the bar-like body 11, such as a straw or the like, is inserted into the passage body 1. In this opening and closing mechanism 111, inserting the bar-like body 11 into the passage portion 2 of the passage body 1 causes the passage portion 2, intimately contacted due to the elastic body 22 held on the lid body 8, to be shoved open, which provides a passage.

The passage portion 2 of the passage body 1 is closed by the bar-like body 11; however, one end of the passage body 1 may be opened, and then pressurized against the elastic force of the elastic body 22, while the object being passed through the passage portion 2 to be transferred.

With a closing mechanism of the invention for an opening of a container, it is possible to subject the closing mechanism to waste disposal such as incineration together with the container at the time of waste disposal after use, and to store the container for several separate eatings and drinkings, since the opening is automatically closed after use so that there is no possibility of spilling while grasping and carrying the container.

Further, when a whole container, with the above closing mechanism included, is made of a single material, the manufacturing process will be simplified. Moreover, disposal after its use will also be simplified, so that the container with high recyclability could be provided.

Also, in this invention, the support body and the lid are composed of plastic material, which simplifies the manufacturing process of the closing mechanism and enables high quantity production of the closing mechanism.

What is claimed is:

1. A closing mechanism for a container opening, comprising:

a support body bent at a predetermined curvature;

a lid body;

a hinge closably joining said lid body and said support body at end portions thereof;

one of said support body and said lid body having a socket penetrating in a thickness direction thereof at an end portion thereof and the other of said support body and said lid body having a hook at an end portion thereof that can be fitted to said socket to close and join said lid body to said support body;

an elastic material capable of closely contacting with said support body, said elastic material having a restoring force; and a closable passage body formed from a soft sheet having opposite sides interposed between said support body and said elastic material;

wherein said passage body and said elastic material are interposed between said support body and said lid body;

wherein said elastic body is pressed by said lid body so as to be bent at a predetermined curvature along said support body; and wherein said passage body is normally closed, but said elastic material is deformed to allow said passage body to open when a rod-shaped body is inserted into said passage body between said support body and said elastic material, and said elastic material is caused by the restoring force thereof to come into close contact with said support body and to close said passage body when the rod-shaped body is pulled out of said passage body.

2. The closing mechanism of claim 1, wherein said support body, said lid body and said elastic material are accommodated in a cylindrical body formed from a soft sheet.

3. The closing mechanism of claim 1, wherein said support body and said lid body have a holding guide therearound.

4. The closing mechanism of claim 1, wherein said support body has an insertion guide through which the rod-shaped body can be inserted.

5. The closing mechanism of claim 1, wherein said lid body has ribs for pressing said passage body to be bent at a predetermined curvature along said support body.

6. The closing mechanism of claim 1, wherein said elastic material comprises an elastic plate for pressing said passage body so as to be bent at a predetermined curvature along said support body.

7. The closing mechanism of claim 6, wherein said elastic plate is selected from the group consisting of a plastic sheet, a metal sheet and a composite sheet of a plastic sheet and a metal sheet.

8. The closing mechanism of claim 1, wherein said elastic material comprises an elastic body for pressing said passage body so as to be bent at a predetermined curvature along said support body.

9. The closing mechanism of claim 8, wherein said elastic body comprises an elastic tube.

10. The closing mechanism of claim 1, wherein said support body and said lid body each comprises a plastic molding.

11. The closing mechanism of claim 1, wherein said passage body comprises two soft sheets adhered to each other at a border portion defining a passage.

12. The closing mechanism of claim 1, wherein said soft sheet is selected from the group consisting of a rubber sheet, a plastic sheet, watertight paper, waterproof paper, aluminum foil, and composites thereof.

* * * * *